US005376949A

United States Patent [19]

Haigh et al.

[11] Patent Number: 5,376,949

[45] Date of Patent: Dec. 27, 1994

[54] DISPLAY SYSTEM WITH GRAPHICS CURSOR

[75] Inventors: David C. Haigh, Winchester; Roy B. Harrison, East Wellow; Helen R. Bonnor, Chandlers Ford, all of England

[73] Assignee: International Business Machines Corp., Armonk, N.Y.

[21] Appl. No.: 108,135

[22] Filed: Aug. 16, 1993

Related U.S. Application Data

[63] Continuation of Ser. No. 879,553, May 4, 1992, abandoned, which is a continuation of Ser. No. 484,147, Feb. 23, 1990, abandoned.

[30] Foreign Application Priority Data

Dec. 10, 1989 [EP] European Pat. Off. ..... 89310460.4

[51] Int. Cl.[5] ..... G09G 1/02

[52] U.S. Cl. ..... 345/196; 345/189; 345/162

[58] Field of Search ..... 345/157, 185, 189, 196, 345/162, 201, 186, 23, 24

[56] References Cited

U.S. PATENT DOCUMENTS

| | | | |
|---|---|---|---|
| 3,911,419 | 10/1975 | Bates . | |
| 4,101,879 | 7/1978 | Kawaji et al. | 340/750 |
| 4,165,506 | 8/1979 | Brands et al. | 340/721 |
| 4,467,322 | 8/1984 | Bell et al. | 340/703 |
| 4,835,526 | 5/1989 | Ishii et al. | 340/703 |
| 4,891,631 | 1/1990 | Foedlund et al. | 340/709 |
| 4,987,551 | 1/1991 | Garrett, Jr. | 340/734 |
| 4,989,163 | 1/1991 | Kawamata et al. | 340/799 |

*Primary Examiner*—Alvin E. Oberley
*Assistant Examiner*—Regina Liang
*Attorney, Agent, or Firm*—Martin J. McKinley

[57] ABSTRACT

A display system has cursor definition memory for storing data defining a graphics cursor, and a cache for the temporary storage of a portion of the graphics cursor for display on a display device, the cache being such that its data rate is sufficient to support the display of the graphics cursor, and control logic for updating the cache from the cursor definition memory at a slower data rate. The cache need only be large enough to store a portion of the cursor at any one time as the graphics cursor is only displayed for a fraction, for example one-tenth, of a scan line and the cache can be updated during the portion of the scan time when the cursor is not displayed. Through the use of a small cache operable at the required data rate, inexpensive memory which does not support the required data rate can be used for the cursor definition memory.

14 Claims, 4 Drawing Sheets

B D A C
R D A C
G D A C
50B
51B
50R
51R
51G
50G
8
24
MERGE LOGIC
46
MAIN PICTURE SERIALISER
48
CURSOR COLOUR DEFINITION REGISTERS
34
CURSOR SERIALISER
44
2
47C
22
CURSOR CACHE
42
30
PC BUS INTERFACE LOGIC
41C
41WA
41RA
4
36
WC
RC
P1
P2
CONTROL LOGIC
37WD
6
39LN
39C
10
37C
37A
37D
CRTC
38
CURSOR POSITION DEFINITION REGISTERS
32
12
CURSOR DEFINITION MEMORY
40

DISPLAY SYSTEM WITH GRAPHICS CURSOR

This is a continuation of application Ser. No. 07/879,553 filed on May 4, 1992 now abandoned, which is a continuation of application Ser. No. 07/484,147 filed on Feb. 23, 1990, now abandoned.

TECHNICAL FIELD

The invention relates to a display system provided with means for displaying a graphics cursor on a display device.

BACKGROUND ART

Graphics cursors, which are also known under other names, such as "sprites", are now a common feature of display systems such as personal computers and the like. However, the provision of a graphics cursor is relatively expensive. This is because of the size of a graphics cursor and the high video rates of modern displays. Typically, a graphics cursor will be up to 64 pixels wide and 64 pixels high, with 2 bits required for each pixel. Thus, 1K bytes of storage are needed to store such a cursor. In order to refresh a display device with a video clock frequency of, say 50 MHz, the cursor data must be read at the rate of 2 bits every 20 nS, or 1 byte every 80 nS. This means that in prior art display systems, expensive, high speed RAM has had to be used for the storage of the data defining the cursor.

SUMMARY OF THE INVENTION

An object of the invention, therefore, is to provide a display system which is able to display a graphics cursor in an economical and efficient manner.

In accordance with the invention, a display system comprises a cursor definition memory for storing data defining a graphics cursor, and a cursor cache for the temporary storage of a portion of the graphics cursor pixel data for display on a scanned display device, the cursor cache being such that its output data rate is sufficient to support the display of the graphics cursor and control logic for updating the cursor cache from the cursor definition memory at a slower data rate.

The invention solves the problem of how to provide a graphics cursor economically and efficiently by temporarily storing part of the cursor information in a cache which can be read at the required data rate. The cache need only be large enough to store a portion of the cursor at any one time. This is because the cursor is only displayed for a fraction, for example one-tenth, of a scan line and the cache can be updated during the portion of the scan time when the cursor is not displayed. Through the use of a small cache, a cursor definition memory can be used to store the data for a graphics cursor which must be displayed at video data rates without requiring that the memory provide data at the video data rate. This memory can therefore can be cheaper than would otherwise be needed.

In a first example, one display line of cursor information is stored in the cache. Thus, for a 64 by 64 pixel graphics cursor with 2 bits per pixel, only 128 bits of fast RAM are needed for the cache.

With slightly different control, the data for only part of a display line of the cursor need be stored. For a 64 by 64 pixel graphics cursor with 2 bits per pixel, as few as 96 bits of fast RAM are required for a data rate factor (cache data rate/memory data rate) of 4. This means that a smaller chip area is needed for an on-chip implementation within an integrated display adapter, than with the first example.

BRIEF DESCRIPTION OF THE DRAWING

A particular example of a display system in accordance with the present invention will be described hereinafter with reference to the accompanying drawings in which.

DESCRIPTION OF THE PREFERRED EMBODIMENTS

Figure 1:
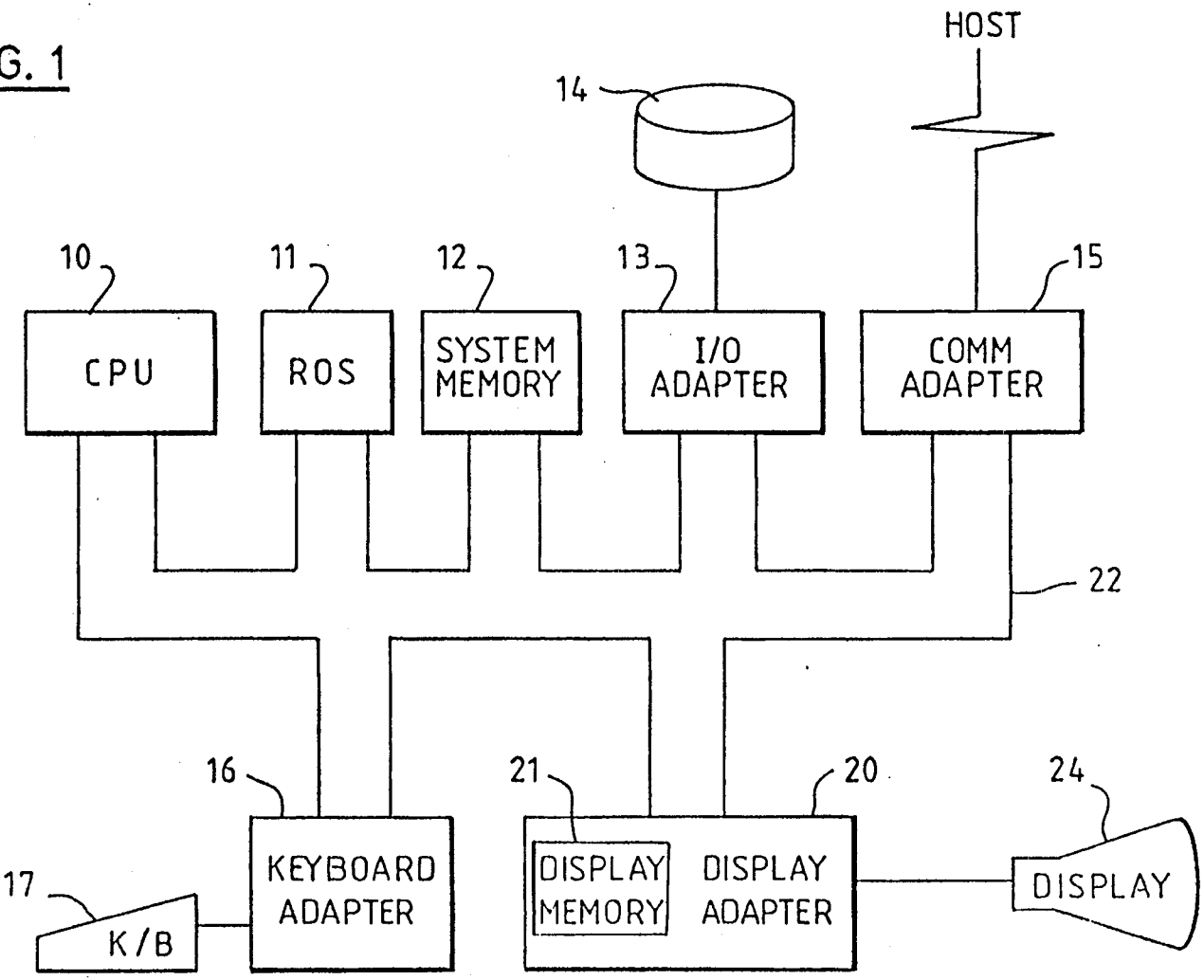
FIG. 1 is an overview of a personal computer including a display system in accordance with the invention.

FIG. 1 illustrates an overview of a conventional workstation comprising a central processing unit 10 in the form of a conventional microprocessor and a number of other units including a display adapter 20 incorporating a display memory 21. The various units are connected to the microprocessor via a system bus 22. Connected to the system bus are a system memory 12 and a read only store (ROS) 11. The operation of the microprocessor is controlled by operation system and application code stored in the ROS and system memory. An I/O adapter 13 is provided for connecting the system bus to the peripheral devices 14 such as disk units. Similarly, a communications adapter 15 is provided for connecting the workstation to external processors (e.g., a host computer). A keyboard 17 is connected to the system bus via a keyboard adapter 16. The display adapter 20 is used for controlling the display of data on a display device 24.

Figure 2:
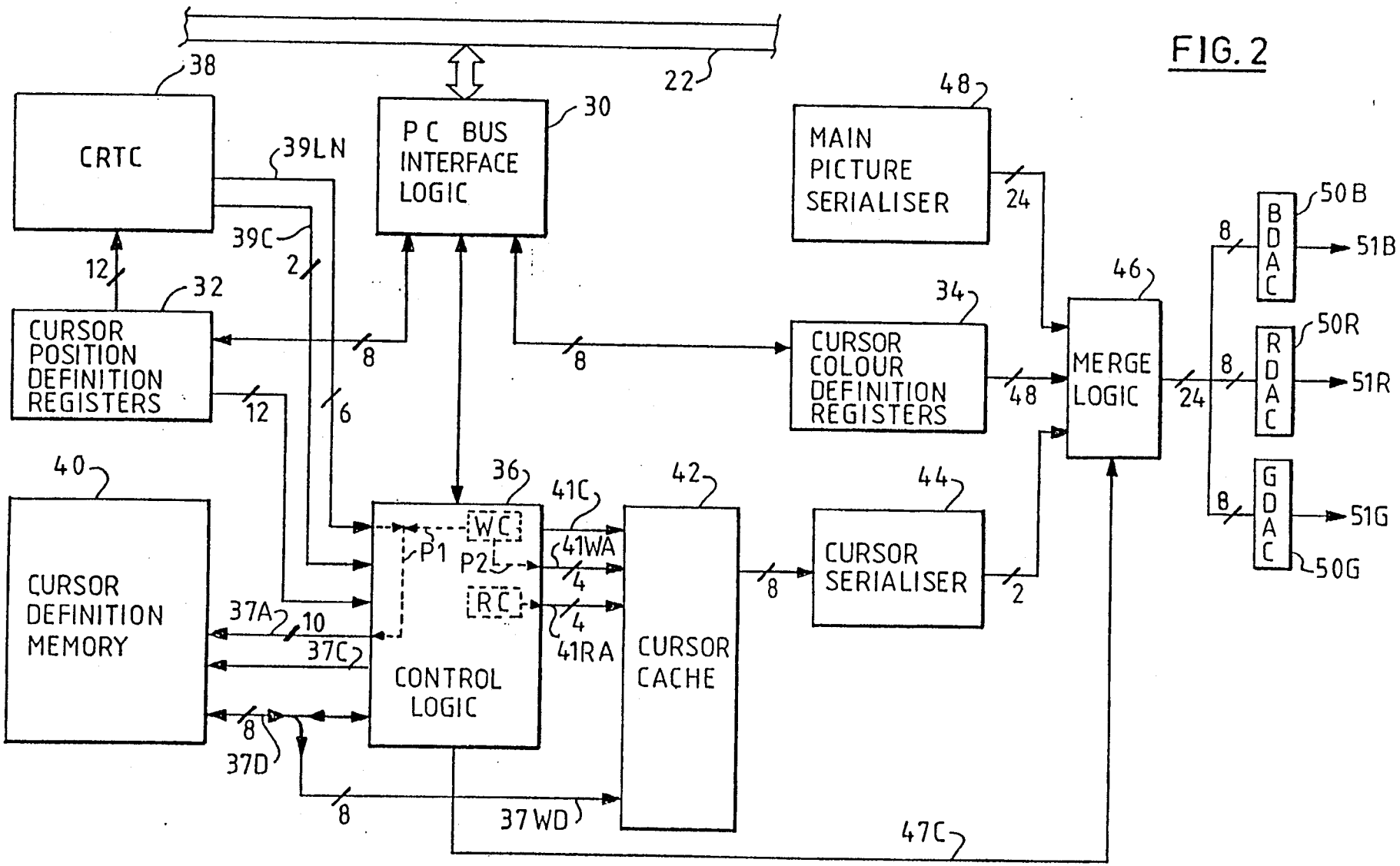
FIG. 2 is a schematic block diagram illustrating elements of a display system in accordance with the invention.

FIG. 2 illustrates an example of a display system in accordance with the invention. In particular, FIG. 2 is a block diagram showing elements of a display adapter for incorporation in a workstation as illustrated in FIG. 1. Only those features of the display adapter which are needed for an understanding of the invention are illustrated. Other elements of the display adapter could be conventional. For example, the display memory for the storage of the main picture information and an associated palette and control circuitry are not shown. The main picture information which is derived from the display memory is output from the main picture serialiser which is shown in FIG. 2.

Although an example of the invention is described in the form of a display adapter for connection to the bus of a personal computer workstation, it should be understood that the term "display system" as used in the claims is not limited to a "display adapter" for use in a workstation or the like, but is intended to include any system capable of displaying data including a graphics cursor. It includes, for example, a complete workstation.

The display adapter is connected to the system bus 22 via bus interface logic 30 which controls the flow of data to and from the bus in a conventional manner. Connected to the interface logic 30 are registers 32, 34 for data defining the cursor position and the cursor colour, respectively. The cursor position and cursor colour data are provided by the workstation application, or by the workstation operating system controlling the data being displayed. The position data identify the screen position of a predetermined point (e.g., the top left corner) of the cursor and is stored in the cursor position registers 32. The cursor colour data are stored in cursor colour data registers 34 and define two colours which may be selected for display by the merge logic 46.

The colour data registers 34 of FIG. 2 comprise two registers of 24 bits each, which assumes that the the total input width of the digital to analogue converter (DAC) stage 50 is 24 bits, (i.e., 8 bits per DAC 50B, 50R, 50G). For systems with 6 bit wide DACs, the colour data registers need only have a width of 18 bits. The output of the blue, red and green DACs (50B, 50R and 50G) are colour signals for controlling the display device.

Also connected to the interface logic 30 is cursor control logic 36 which controls the display of the cursor in response to commands from the PC bus and from a cathode ray tube controller (CRTC) 38.

Bit maps defining the shape of the cursors are stored in a cursor definition memory 40. The cursor definition memory 40 can be implemented as part of general purpose memory, although here it is implemented as a special purpose random access memory. In display modes in which a graphics cursor is required (e.g., display modes in which graphics or image data are displayed) this memory 40 is dedicated to the storage of the bit maps for the available graphics cursor. For display modes in which a graphics cursor is not needed (e.g., character display modes) this memory 40 is available for the storage of, for example, fonts or character sets. Such RAM need not be fast, because in alphanumeric modes it would be accessed only once every character, which at a typical alphanumeric video frequency of 30 MHz may be every 300 nS. Hence, there could be a data rate mismatch of a factor of 3 or 4 between the requirements of the cursor and that which the RAM can provide.

The cursor control logic 36 accesses the cursor definition memory via control and address lines 37C and 37A to cause cursor pixel data to be loaded into a cursor cache 42 via data lines 37D and 37WD. The cursor cache 42 is implemented in static storage which, in display modes for which a graphics cursor is provided, is dedicated to the temporary storage of cursor pixel information. The cursor cache is shown to be accessed via separate address lines for reading and writing (41RA and 41WA). In other words, it is configured as a dual port memory in this example. Read/write operations are additionally controlled via control line 41C.

It should be noted that the cursor cache 42 could be made available for the storage, in display modes for which a graphics cursor is not required, of other data by the provision of extra logic (not shown). For example, it could be configured as a small palette memory for colour information.

The output of the cursor cache is connected to a cursor serialiser 44 where the cursor data from the cursor cache is serialised. The serialised cursor data is used with additional control information from the cursor control logic via line 47C to control the merge logic 46 to merge the output of the main picture serialiser with the content of the cursor colour definition registers 34. Thus, the cursor can be designated to be a specific colour in all situations, or one of a number of colours dependent on the underlying picture information to ensure that the cursor is always visible. In order to do this the output from the cursor serialiser is two bits wide enabling the selection of one of the two colours from the cursor colour data registers 34, or the colour from the main picture serialiser 48 (i.e., to make the cursor transparent) or the chromatic complement of the colour from the main picture serialiser.

There follows a general description of the operation of the CRTC 38, which is responsible for controlling the times of events both within a scan line and within a field of the display. As is conventional, it contains two counters, a horizontal counter and a vertical counter (not shown). The horizontal counter counts in units of 8 pels (characters) and the vertical counter counts lines. As is also conventional, comparators (not shown) compare the values in these counters with values in parameter registers in order to be able to signal the start and end of such events as blanking and synchronisation pulses. In particular, a pair of parameter registers, formed by the cursor position registers 32, are used to define the horizontal and vertical position of the top left hand pixel of the cursor.

On every scan line the CRTC sends the cursor control logic 36 a start signal via one of the lines 39C at the appropriate time which tells it to start to display the cursor. Because the horizontal counter counts characters rather than pixels the low-order 3 bits of the horizontal cursor position are not used by the CRTC. Instead, the cursor control logic 36 uses these 3 bits to define a delay of 0 to 7 pels, and the start signal is delayed by this amount before being used to start the display of the cursor. In this way the horizontal position of the cursor can be controlled with the accuracy of 1 pixel.

At the beginning of every scan line the CRTC 38 tells the cursor control logic 36 via one of the control lines 39C whether the cursor should be displayed on the scan line or not; the vertical position of the cursor can be thereby controlled with the accuracy of 1 line. On lines which do not contain the cursor, the cursor control logic 36 forces the outputs of the cursor serialiser to the transparent state by means of a control signal on the path 47C.

The CRTC 38 also contains a counter (not shown) which keeps track of which line of the cursor is to be displayed next. At the beginning of every scan line the CRTC sends the cursor control logic 36 (via lines 39LN) the line number of the cursor line which is to be fetched from the cursor definition memory 40 and stored in the cursor cache 42 during that scan line. This cached cursor data is then displayed on the next scan line. For a display device operating in a non-interlaced mode, the cursor line number sent by the CRTC is 1 more than the line number of the cursor to be displayed on the scan line. For an interlaced display mode it will be 2 more.

The cursor control logic 36 goes through the motions of displaying the cursor and fetching the next line of cursor data from the cursor definition memory 40 and storing it in the cache, regardless of whether the cursor is to be displayed on that line or not. This provides for an efficient yet uncomplicated implementation of the control logic. The logic is arranged to start scanning on a non-display line of the display screen (e.g., a horizontal blanking line). This means that the data for the first line of the cursor will be cached correctly, without the need for special case logic for the first line. The output of the cursor serialiser is forced to the transparent state at all times within the scan line and the frame when the cursor should not appear.

Assuming a cursor definition memory 40 data width of 1 byte, 1024 locations are needed to store a 64×64×2 cursor. Therefore, the addresses from the cursor control logic to the cursor definition memory 40 via address lines 37A are 10 bits wide. The high order 6 bits of this address is the line address bits on lines 39LN from the CRTC, which define which of the 64 lines of the cursor is to be displayed next. The low order 4 bits of the cursor definition memory 40 addresses are obtained from a 4-bit count which is maintained in a counter WC by the cursor control logic; this being reset to 0 before each line of the cursor is fetched and being incremented by 1 after each byte of data has been read from the cursor definition memory 40. The merging of the six bits from the lines 39LN and the four bits from the counter WC for addressing the cursor definition memory via lines 37A is represented schematically in FIG. 2 by the dotted lines P1.

In a first, straightforward, implementation the cursor cache write data width is equal to the cursor definition memory data width, so this same 4-bit counter can also generate the write address 41WA for the cursor cache 42. This is illustrated schematically by the dotted line P2 in FIG. 2. If the cursor cache can store an entire cursor line, the actual counter outputs can be the actual cursor cache write address.

If, as in a second implementation, the cursor cache cannot store an entire cursor line, a modulo transformation must be applied to the 4-bit count. For example, if the cursor cache has a capacity of 12 bytes, the cursor cache write address must count modulo 12, so the count values 12 to 15 are transformed into cursor cache write address values of 0 to 3.

The 4-bit count can also be used to indicate when the entire line of cursor data has been fetched from the cursor definition memory 40. This is indicated by the count wrapping from 15 to 0. In the case of a 12 byte cursor cache, a count value of 12 indicates that the cache is full and fetching must pause until display of the cursor starts.

If the cursor cache is smaller than 16 bytes a cursor cache read address count (maintained in a second counter RC) operates quite independently of the other address registers. Its size will depend on the read data width chosen for the cursor cache. This need not be the same as the write data width. By the provision of two sets of address lines 41WA/41RA, the example of FIG. 2 provides for this.

If the cursor cache is the full size of 16 bytes the cursor cache may be single ported and in this case the 4-bit counter WC can double as the cursor cache read address counter. In such a case, only one set of cursor cache address lines need be provided.

In either case the cursor serialiser 44 transforms the width of the data read from the cache into the width needed by the merge logic.

Figure 3:
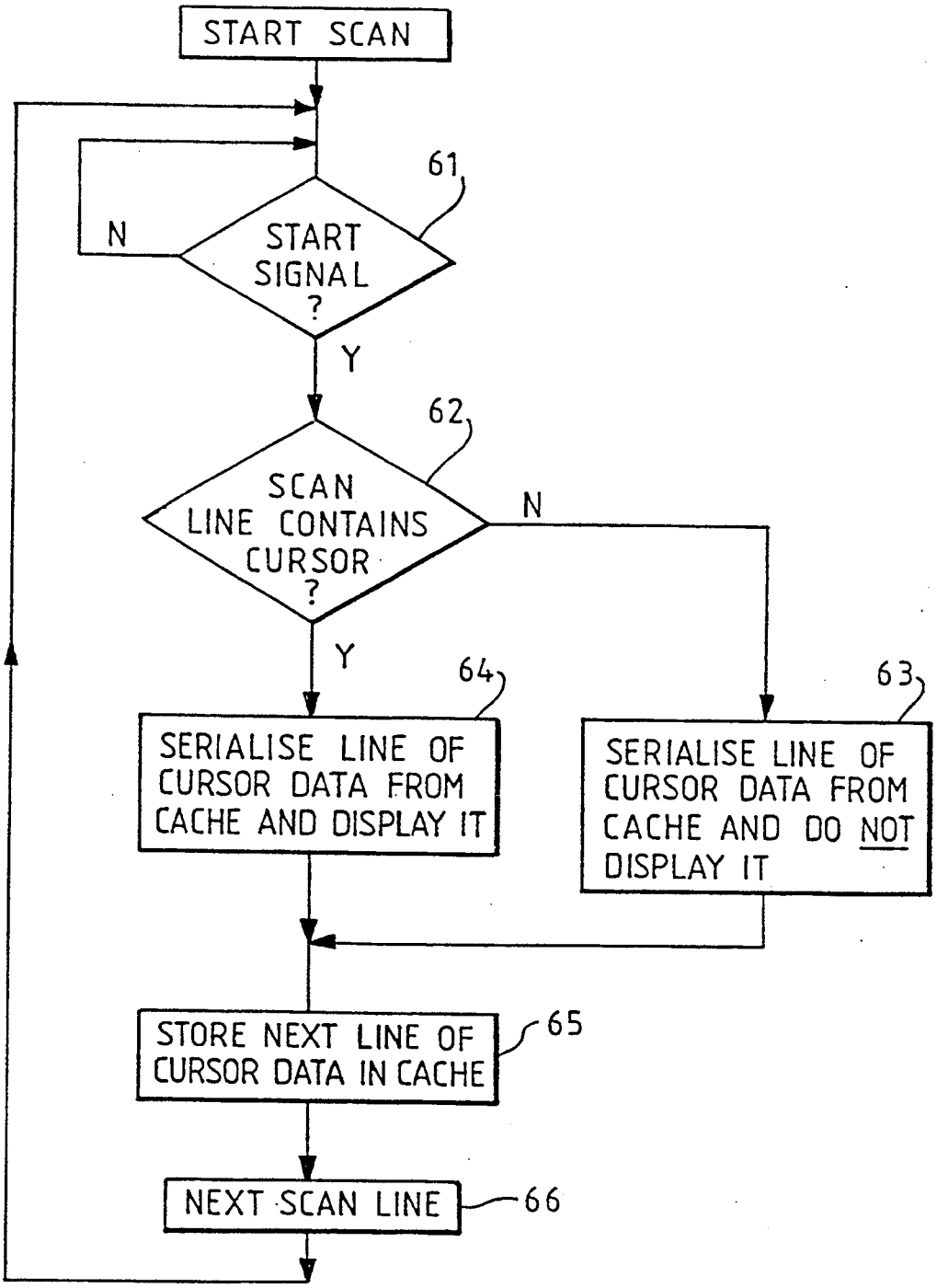
FIG. 3 is a flow diagram showing the operation of a first example of a display system in accordance with the invention.

An example of the operation of the control logic 36 of FIG. 2 will now be described with reference to FIG. 3. However, it is assumed here that all the cursor information for one display line is stored in the cache at any one time. In other words, the provision of separate read and write address lines 41WA/41RA for the cursor cache of FIG. 2 are not necessary.

A. The cursor control logic waits (61) for the start signal on one of the lines 39C and delays it as described above.

B1. On scan lines which do not contain a cursor (62-N), the cursor control logic causes the line of cursor data in the cursor cache to be serialised, but causes the display of the cursor to be inhibited (63) by making the merge logic select the main palette serialiser colour as described above.

B2. On scan lines which do contain the cursor (62-Y), the cursor control logic causes the line of cursor data in the cursor cache to be serialised and displayed (64) via the merge logic.

C. When the display of the current line of the cursor is complete, the next line of cursor data is read from the cursor definition memory and stored (65) in the cursor cache, where it is ready for the display of the next line of the cursor.

Steps A, B1/B2 and C are repeated (66) as appropriate for successive scan lines.

Assuming that the cursor cache only has a single data port, the updating of the cursor cache can occur in this example at times when the cursor data is not being output from the cursor cache to the cursor serialiser.

To reduce the size of the cache, advantage may be taken of the fact that some of the data for the current cursor line may be read from the slow RAM while the cursor is being displayed. Suppose the cache contains 48 cursor pixels and the data rate ratio is 4. While the first 48 pixels are being displayed, it is possible to fetch 12 more pixels from the slow RAM; while these 12 pixels are being displayed, a further 3 pixels may be fetched, making 63 in all. In this example, by starting the access of the slow RAM before the first cursor pixel is read, so that the first of the group of 12 pixels is written to the cache immediately after the data originally in that cache location has been read, it is possible to ensure that the 64th pixel is written to the cache before it is needed. In other cases, this early restart of the slow RAM accesses may not be necessary.

Figure 4:
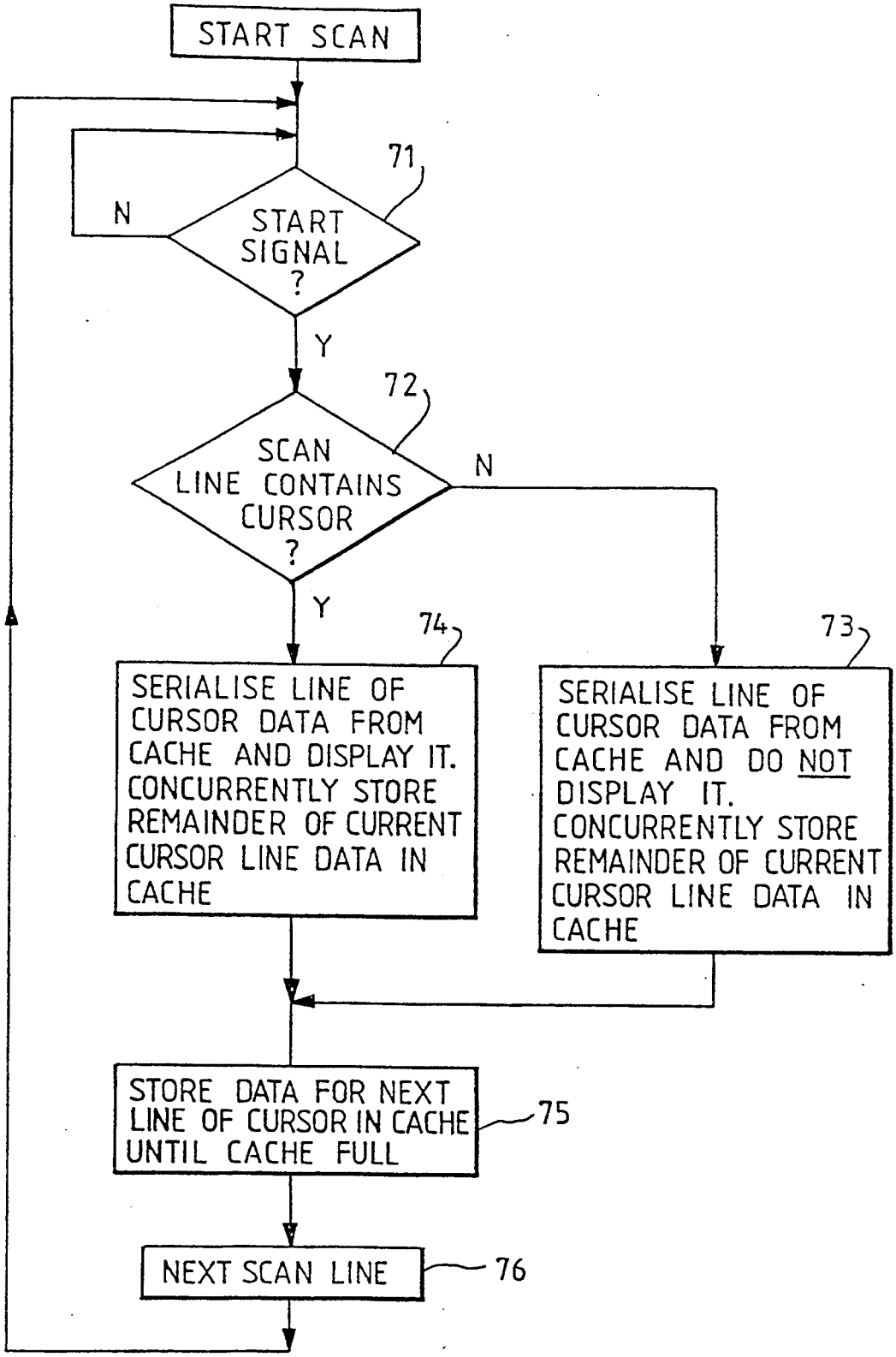
FIG. 4 is a flow diagram showing the operation of a second example of a display system in accordance with the invention.

This technique does require that the cache be dual-ported, because it is necessary to write and read different addresses simultaneously. No additional control information is needed from the CRTC in order that the cursor control logic may operate in this way. The operation of the cursor control logic in this example is described with reference to the flow diagram in FIG. 4:

A. The cursor control logic waits (71) for the start signal on one of the lines 39C and delays it as described above.

B1. On scan lines which do not contain a cursor (72-N), the cursor control logic causes the part of the line of cursor data in the cursor cache to be serialised, but causes the display of the cursor to be inhibited (73) by making the merge logic select the main palette serialiser colour as described above. At the same time, if necessary after a suitable delay, accesses of the cursor definition memory are restarted. Further cursor definition data then overwrites the data that have just been used to define the appearance of the cursor.

B2. On scan lines which do contain the cursor (72-Y), the cursor control logic causes the part of the line of cursor data in the cursor cache to be serialised and displayed (74) via the merge logic. At the same time, if necessary after a suitable delay, accesses of the cursor definition memory are restarted. Further cursor definition data then overwrites the data that have just been used to define the appearance of the cursor and these further data are used in turn to complete the display of the line of the cursor.

C. When the display of the current line of the cursor is complete, part of the next line of cursor data is read from the cursor definition memory and stored (75) in the cursor cache until the cache is full, where it is ready for the display of the next line of the cursor.

Steps A, B or C are repeated as appropriate for successive scan lines (76).

In this example therefore, the cursor cache is at least partially updated during times when cursor data is being output from the cursor cache to the cursor serialiser.

The invention enables a graphics cursor to be provided in an economic manner through the use of a small high speed cache for the temporary storage of part of the graphics cursor in combination with a slow and cheap RAM for the complete definition of that cursor.

We claim:

1. A display system for displaying cursor graphics on a raster scan display device, wherein cursor graphics data is organized in a plurality of scan lines, and wherein the cursor graphics data for a selected scan line of a single cursor image is organized in a 1st group of "M" bytes followed by a 2nd group of "N" bytes of cursor graphics data, wherein M and N are non-zero integers such that the total number of bytes of cursor graphics data in the selected scan line is "M+N" bytes, wherein each byte stores a plurality of bits of data, said display system for use with a cursor definition memory for storing cursor graphics data, said display system comprising in combination:

a cursor cache including M addressable storage locations for the temporary storage of cursor graphics data, said cursor cache having a data input for connection to a data output of the cursor definition memory;

a serializer for serializing cursor graphics data, a data input of said serializer being coupled to a data output of said cursor cache; and control logic for updating said cursor cache with cursor graphics data from the cursor definition memory, and for updating said serializer with cursor graphics data from said cursor cache, said control logic including:

first control means for fetching said 1st group of bytes of the selected scan line of cursor graphics data from the cursor definition memory, and for temporarily storing said 1st group of bytes in said cursor cache;

second control means for loading said serializer with cursor graphics data from said cursor cache; and said first control means further including means for fetching said 2nd group of bytes of the selected scan line of cursor graphics data from the cursor definition memory, and for temporarily storing said 2nd group of bytes in said cursor cache, so that each byte of said 2nd group replaces a corresponding byte of said 1st group after said corresponding byte of said 1st group has been loaded into said serializer.

2. The display system of claim 1, further comprising:

a vertical position register for storing data indicative of the vertical position of the cursor graphics; and means for generating a line number signal indicative of the number of the next scan line of cursor graphics to be displayed, wherein said line number signal is used to address the cursor definition memory to retrieve the next scan line of cursor graphics data.

3. The display system of claim 2, further comprising:

a horizontal position register for storing data indicative of the horizontal starting position of the cursor graphics; and means for generating a start cursor signal to indicate the horizontal starting position of the cursor graphics.

4. The display system of claim 3, further comprising:

a source of main picture color data;

a cursor color definition register for selecting a first cursor color independent of the color of said main picture color data, whereby color cursor graphics data is produced; and means for merging said color cursor graphics data with said main picture color data.

5. The display system of claim 4, wherein each pixel of cursor graphics data is defined by a plurality of bits, such that each pixel may be programmed to one of at least three states, the first state selecting said first color, the second state selecting a transparent cursor pixel, and the third state selecting a color that is the chromatic complement of the corresponding pixel in said main picture color data.

6. The display system of claim 1, further comprising:

a source of main picture color data;

a cursor color definition register for selecting a first cursor color independent of the color of said main picture color data, whereby color cursor graphics data is produced: and means for merging said color cursor graphics data with said main picture color data.

7. The display system of claim 6, wherein each pixel of cursor graphics data is defined by a plurality of bits, such that each pixel may be programmed to one of at least three states, the first state selecting said first color, the second state selecting a transparent cursor pixel, and the third state selecting a color that is the chromatic complement of the corresponding pixel in said main picture color data.

8. A computer system, comprising in combination:

at least one processor unit;

a system memory;

a bus for connecting said system memory to said processor unit; and a display sub-system for displaying cursor graphics on a raster scan display device, wherein cursor graphics data is organized in a plurality of scan lines, and wherein the cursor graphics data for a selected scan line of a single cursor image is organized in a 1st group of "M" bytes followed by a 2nd group of "N" bytes of cursor graphics data, wherein M and N are non-zero integers such that the total number of bytes of cursor graphics data in the selected scan line is "M+N" bytes, wherein each byte stores a plurality of bits of data, said display sub-system being coupled to said bus, said display subsystem comprising in combination:

a cursor definition memory for storing cursor graphics data;

a cursor cache including M addressable storage locations for the temporary storage of cursor graphics data, said cursor cache having a data input for connection to a data output of said cursor definition memory;

a serializer for serializing cursor graphics data, a data input of said serializer being coupled to a data output of said cursor cache; and control logic for updating said cursor cache with cursor graphics data from said cursor definition memory, and for updating said serializer with cursor graphics data from said cursor cache, said control logic including:

first control means for fetching said 1st group of bytes of the selected scan line of cursor graphics data from said cursor definition memory, and for temporarily storing said 1st group of bytes in said cursor cache;

second control means for loading said serializer with cursor graphics data from said cursor cache; and said first control means further including means for fetching said 2nd group of bytes of the selected scan line of cursor graphics data from said cursor definition memory, and for temporarily storing said 2nd group of bytes in said cursor cache, so that each byte of said 2nd group replaces a corresponding byte of said 1st group after said corresponding byte of said 1st group has been loaded into said serializer.

9. The computer system of claim 8, wherein said display sub-system further comprises:

a vertical position register for storing data indicative of the vertical position of the cursor graphics; and means for generating a line number signal indicative of the number of the next scan line of cursor graphics to be displayed, wherein said line number signal is used to address said cursor definition memory to retrieve the next scan line of cursor graphics data.

10. The computer system of claim 9, wherein said display sub-system further comprises:

a horizontal position register for storing data indicative of the horizontal starting position of the cursor graphics; and means for generating a start cursor signal to indicate the horizontal starting position of the cursor graphics.

11. The computer system of claim 10, wherein said display sub-system further comprises:

a source of main picture color data;

a cursor color definition register for selecting a first cursor color independent of the color of said main picture color data, whereby color cursor graphics data is produced; and means for merging said color cursor graphics data with said main picture color data.

12. The computer system of claim 11, wherein each pixel of cursor graphics data is defined by a plurality of bits, such that each pixel may be programmed to one of at least three states, the first state selecting said first color, the second state selecting a transparent cursor pixel, and the third state selecting a color that is the chromatic complement of the corresponding pixel in said main picture color data.

13. The computer system of claim 8, wherein said display sub-system further comprises:

a source of main picture color data;

a cursor color definition register for selecting a first cursor color independent of the color of said main picture color data, whereby color cursor graphics data is produced; and means for merging said color cursor graphics data with said main picture color data.

14. The computer system of claim 13, wherein each pixel of cursor graphics data is defined by a plurality of bits, such that each pixel may be programmed to one of at least three states, the first state selecting said first color, the second state selecting a transparent cursor pixel, and the third state selecting a color that is the chromatic complement of the corresponding pixel in said main picture color data.

* * * * *